US007258320B2

(12) United States Patent
Tai

(10) Patent No.: US 7,258,320 B2
(45) Date of Patent: Aug. 21, 2007

(54) FOLDING SHEET MUSIC STAND

(75) Inventor: Jonathan Tai, Shanghai (CN)

(73) Assignee: Shanghai Max Precision Instrument Co., Ltd., Shanghai (CN)

( * ) Notice: Subject to any disclaimer, the term of this patent is extended or adjusted under 35 U.S.C. 154(b) by 0 days.

(21) Appl. No.: 11/138,749

(22) Filed: May 25, 2005

(65) Prior Publication Data

US 2006/0175523 A1 Aug. 10, 2006

Related U.S. Application Data

(63) Continuation of application No. 29/221,825, filed on Jan. 20, 2005.

(51) Int. Cl.
*A47B 97/00* (2006.01)

(52) U.S. Cl. ..... 248/460; 248/463; 248/166

(58) Field of Classification Search ..... 248/460, 248/463, 464, 446, 441.1
See application file for complete search history.

(56) References Cited

U.S. PATENT DOCUMENTS

| | | | | |
|---|---|---|---|---|
| 230,851 | A | 8/1880 | Anthony | |
| 368,426 | A | 8/1887 | Rutmann | |
| 575,729 | A * | 1/1897 | Palmer | 248/448 |
| 730,062 | A | 6/1903 | Widmer | |
| 1,359,811 | A * | 11/1920 | Kirkendall et al. | 248/462 |
| 1,673,205 | A | 6/1928 | Romao | |
| 1,684,912 | A | 9/1928 | Dunklau | |
| 1,862,562 | A * | 6/1932 | Aldeen et al. | 248/447 |
| 1,863,756 | A | 6/1932 | Lufkin | |
| 2,547,924 | A | 4/1951 | Citro | |
| 2,559,200 | A | 7/1951 | Schaf | |
| 2,630,289 | A | 3/1953 | Selig | |
| 2,727,708 | A | 12/1955 | Lorenzen | |
| 2,940,709 | A | 6/1960 | Neuwirth | |
| 3,057,591 | A | 10/1962 | Weimer | |
| 3,526,380 | A | 9/1970 | Tong | |
| D223,638 | S | 5/1972 | Smith | |
| 3,709,454 | A | 1/1973 | Hyde | |
| 3,804,355 | A | 4/1974 | Uroshevich | |
| 3,881,675 | A | 5/1975 | Matchett | |
| D236,227 | S | 8/1975 | Kester, Jr. | |
| 3,938,772 | A * | 2/1976 | Andrusiak | 248/461 |
| 3,958,786 | A | 5/1976 | Mann | |
| 4,010,922 | A | 3/1977 | Heller | |

(Continued)

OTHER PUBLICATIONS

Hamilton Orchestra Music Stands Brochure; Hamilton Stands Incorporated; Middletown, Ohio.

(Continued)

*Primary Examiner*—Amy J. Sterling
*Assistant Examiner*—Steven M. Marsh
(74) *Attorney, Agent, or Firm*—William W. Cochran; Cochran Freund & Young LLC

(57) ABSTRACT

Disclosed is a folding sheet music stand that is capable of being folded into a very compact package. In the folded position, the folding sheet music stand is easily transportable and less susceptible to damage. A carrying bag can be used to transport the folded sheet music stand. The folding sheet music stand can be easily assembled and provides a sturdy platform for displaying folded sheet music to musicians. The folding sheet music stand is fully adjustable so that the folding sheet music stand can be used by musicians using various different types of instruments.

4 Claims, 20 Drawing Sheets

U.S. PATENT DOCUMENTS

| | | | | | |
|---|---|---|---|---|---|
| 4,061,302 | A | | 12/1977 | Boone | |
| 4,099,441 | A | | 7/1978 | Landon | |
| 4,205,818 | A | | 6/1980 | Lawler | |
| 4,317,552 | A | | 3/1982 | Weidler | |
| D265,873 | S | | 8/1982 | Smith | |
| 4,352,480 | A | | 10/1982 | Gathright | |
| 4,561,339 | A | | 12/1985 | Jensen | |
| 4,582,282 | A | | 4/1986 | Gracie | |
| 4,671,479 | A | | 6/1987 | Johnson | |
| 4,691,610 | A | | 9/1987 | Gilbert | |
| 4,693,161 | A | | 9/1987 | Uhrig | |
| 4,695,021 | A | | 9/1987 | Leinfelder | |
| 4,712,756 | A | | 12/1987 | Kester | |
| 4,744,536 | A | | 5/1988 | Bancalari | |
| 4,785,708 | A | | 11/1988 | Vaughan | |
| D299,244 | S | | 1/1989 | Jones | |
| 4,807,837 | A | | 2/1989 | Gawlik | |
| 4,890,531 | A | | 1/1990 | Tischer | |
| 4,923,156 | A | | 5/1990 | Linneusson | |
| 5,029,796 | A | | 7/1991 | Schoenig | |
| 5,037,057 | A | * | 8/1991 | Andrews | 248/460 |
| 5,060,894 | A | | 10/1991 | Hillinger | |
| 5,114,111 | A | * | 5/1992 | Andrews | 248/460 |
| D329,342 | S | | 9/1992 | Schoenig | |
| 5,165,635 | A | * | 11/1992 | Hoshino | 248/169 |
| D332,882 | S | | 2/1993 | Graves | |
| 5,197,701 | A | | 3/1993 | Olson | |
| 5,213,296 | A | | 5/1993 | Lee | |
| 5,340,066 | A | | 8/1994 | Ditch | |
| 5,350,143 | A | | 9/1994 | Hoshino | |
| D353,729 | S | | 12/1994 | MacOwan | |
| 5,375,497 | A | | 12/1994 | Pirchio | |
| 5,383,634 | A | | 1/1995 | Liao | |
| D356,901 | S | | 4/1995 | Schoenig et al. | |
| D357,828 | S | | 5/1995 | Liao | |
| 5,454,473 | A | | 10/1995 | Hennessey | |
| 5,497,689 | A | | 3/1996 | Hoshino | |
| 5,505,413 | A | | 4/1996 | Hennessey | |
| D370,369 | S | | 6/1996 | Nordstrom | |
| D375,003 | S | | 10/1996 | Nordstrom | |
| 5,664,756 | A | | 9/1997 | Liao | |
| 5,692,719 | A | * | 12/1997 | Shepherd | 248/460 |
| D389,341 | S | | 1/1998 | Danner | |
| 5,713,547 | A | | 2/1998 | Yu | |
| D392,123 | S | | 3/1998 | Lynch | |
| 5,726,369 | A | | 3/1998 | Gilday | |
| 5,744,735 | A | | 4/1998 | Liao | |
| D394,764 | S | | 6/1998 | Nordstrom | |
| D396,579 | S | | 8/1998 | Kalayjian | |
| D400,734 | S | | 11/1998 | Dotson | |
| 5,836,552 | A | | 11/1998 | Yu | |
| 5,852,250 | A | | 12/1998 | Cha | |
| D407,240 | S | | 3/1999 | Payne | |
| D408,179 | S | | 4/1999 | Rellinger | |
| D408,653 | S | | 4/1999 | Dotson | |
| D411,698 | S | | 6/1999 | Kalayjian | |
| 5,934,628 | A | | 8/1999 | Bosnakovic | |
| 5,957,417 | A | | 9/1999 | Yu | |
| 5,959,225 | A | | 9/1999 | Hsu | |
| D414,962 | S | | 10/1999 | Welsh | |
| 5,973,244 | A | | 10/1999 | McCulloch | |
| 6,005,176 | A | | 12/1999 | Yu | |
| D419,707 | S | | 1/2000 | Tierney | |
| 6,015,121 | A | | 1/2000 | Reid | |
| D421,447 | S | | 3/2000 | Eason et al. | |
| 6,036,159 | A | | 3/2000 | Yu | |
| 6,113,040 | A | | 9/2000 | Yu | |
| 6,121,527 | A | | 9/2000 | Hamm | |
| 6,127,612 | A | | 10/2000 | Yu | |
| D435,365 | S | | 12/2000 | Eason | |
| 6,209,829 | B1 | | 4/2001 | Yu | |
| 6,281,417 | B1 | | 8/2001 | Ladao | |
| 6,283,421 | B1 | | 9/2001 | Eason | |
| 6,323,405 | B1 | | 11/2001 | Yu | |
| 6,375,135 | B1 | | 4/2002 | Eason | |
| 6,439,532 | B1 | | 8/2002 | Yu | |
| 6,513,768 | B1 | | 2/2003 | Hsieh | |
| 6,682,042 | B2 | * | 1/2004 | Anderson | 248/460 |
| D509,162 | S | * | 9/2005 | Barnes | D11/11 |
| 2002/0070319 | A1 | | 6/2002 | Yu | |
| 2002/0088914 | A1 | | 7/2002 | Yu | |

OTHER PUBLICATIONS

Hercules Stands—Microphone Stands; Kaman Music Corporation; Bloomfield Connecticut 2003.

http://www.guitarvings.com; Monteleone Instruments; Islip, NY.

http://www.hamiltonstands.com/guitar_stands.htm; Hamilton Stands, Inc.; Middletown, OH.

http://www.activemusician.com; Adam Hanger Guitar Stand.

http://www..zzounds.com; Hercules GS414B Auto Grab System Guitar Stand.

http://www.wholenote.com; Hamilton Guitar Stand—The Hanger—Chrome.

http://www.samash.com; Hercules—GS414B Single Auto-Grab Guitar Stand.

Hamilton School and Orchestra Stands, Conductors' Stands; Folding Stands, Instrument Stands Brochure; Hamilton Stands Incorporated.

Ultimate Support Systems, Inc. Product Catalog 2004; Fort Collins, Colorado.

http://www.activemusician.com; Hamilton Guitar Stand—Standard.

* cited by examiner

FOLDING SHEET MUSIC STAND

CROSS-REFERENCE TO RELATED APPLICATIONS

This application is a continuation of U.S. Design application Ser. No. 29/221,825, filed Jan. 20, 2005, entitled "Music Stand" by Jonathan Tai, the entire contents of which is hereby specifically incorporated herein for all that it discloses and teaches.

BACKGROUND OF THE INVENTION a. Field of the Invention

The present invention pertains generally to sheet music stands and more particularly to folding sheet music stands.

b. Description of the Background

The transportation of musical instruments and the associated hardware is difficult because of the bulkiness and fragility of these items. Sheet music stands, in particular, have been built to be lightweight and are very fragile. As such, sheet music stands are very susceptible to damage during transport.

SUMMARY OF THE INVENTION

An embodiment of the present invention may comprise a folding sheet music stand that provides a sturdy platform for holding sheet music, is adjustable for different heights and orientations and is capable of being folded into a compact package that can be easily carried without damage to the folding sheet music stand comprising: a main shaft; a collar surrounding the main shaft; a first clamp attached to the collar assembly that fixes the main shaft with respect to the collar assembly and allows adjustment of the position of the main shaft with respect to the collar assembly; folding legs that support the folding sheet music stand; leg hinges attached to the collar assembly and the folding legs that allow the folding legs to fold to a compact position and to open to an open position to support the folding sheet music stand; a secondary shaft disposed inside of the main shaft, the secondary shaft having a size that allows the secondary shaft to fit firmly in the main shaft and to slide in the main shaft; a second clamp attached to the main shaft that fixes the main shaft with respect to the secondary shaft and forms an extendable leg assembly that includes the main shaft, the collar, and first clamp, the folding legs, the leg hinges, the secondary shaft and the second clamp; a back sheet music holder having a plurality of folding back plates that are attached by hinges that allow the back sheet music holder to fold to a closed position, the hinges attached to the folding back plates so that the folding back plates can rotate to form a flat surface and abut with one another; flanges formed on the back sheet music holder that form a slot; a bottom sheet music holder having a ridge formed along one edge, the ridge having a size and shape that allows the ridge to slide firmly within the slot so as to fix the folding back plates in a stationary, flat position; a shaft tightening hinge attached to the back sheet music holder and to the secondary shaft so that the leg assembly can be rotated along one plane and fixed in a desired orientation with respect to the back sheet music holder.

Another embodiment of the present invention may comprise a method of folding a sheet music stand into a compact package for transport comprising: providing a main shaft; providing a collar; attaching a first clamp to the collar that allows the main shaft to slide in the collar and fix the collar on the main shaft; attaching leg hinges to the collar; attaching folding legs to the leg hinges; disposing a secondary shaft in the main shaft, the secondary shaft having a size that allows the secondary shaft to slide in the main shaft; attaching a second clamp to the main shaft to fix the secondary shaft with respect to the main shaft; attaching a shaft tightening hinge to the secondary shaft; attaching a back sheet music holder to the shaft tightening hinge, the back sheet music holder comprising a plurality of folding back plates; attaching the plurality of folding back plates using hinges so that the folding back plates can rotate to form a flat surface and rotate to fold together; providing flanges on the plurality of folding back plates that form a slot when the folding back plates are rotated to form a flat surface; providing a bottom sheet music holder having a ridge; sliding the ridge into the slot to fix the plurality of folding back plates in a fixed stationary position.

DETAILED DESCRIPTION OF THE INVENTION

Figure 1:
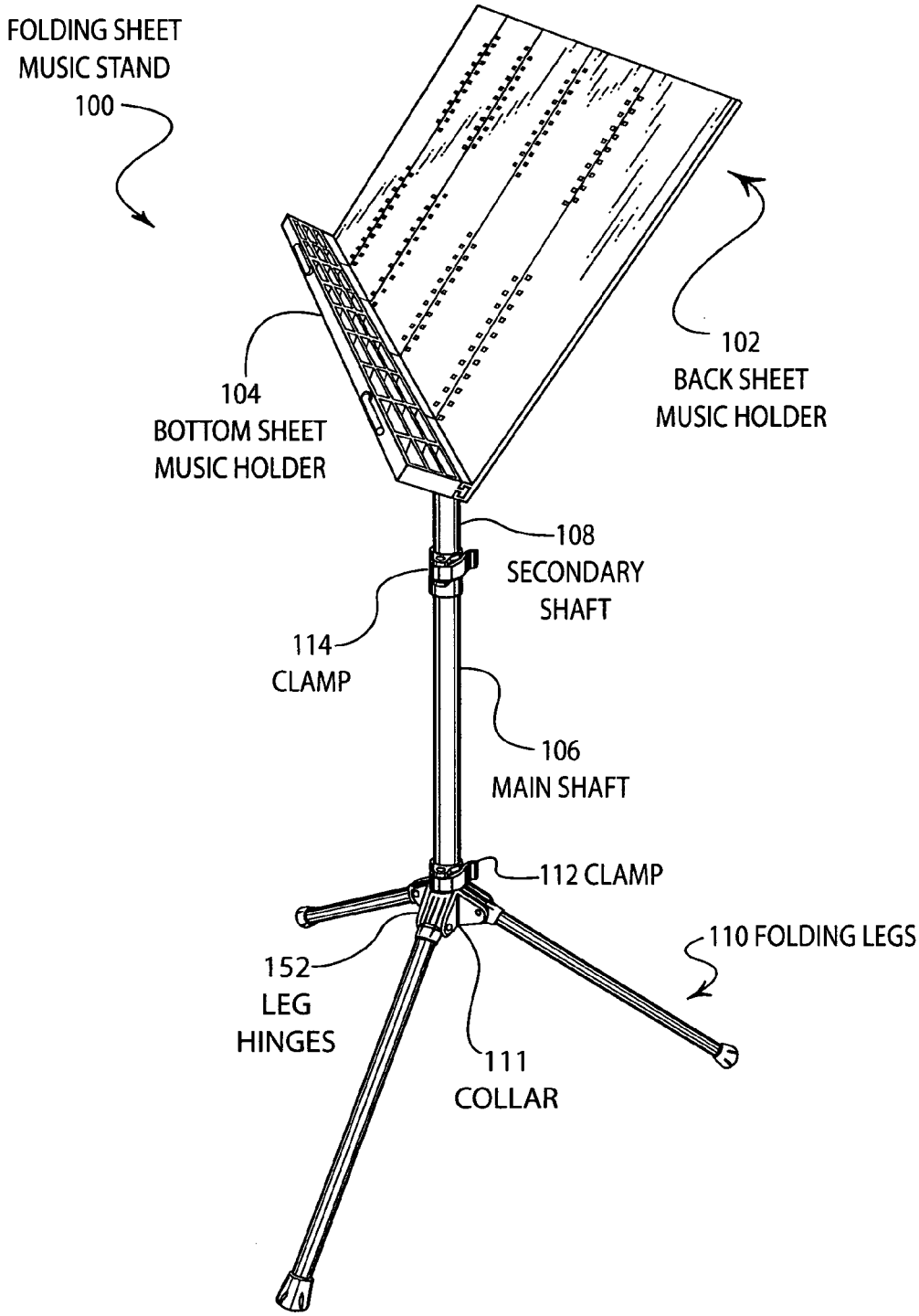
FIG. 1 is an isometric view of one embodiment of a folding sheet music stand.

FIG. 1 is an isometric view of one embodiment of a folding sheet music stand 100. The folding sheet music stand is capable of being folded into a compact unit that is easy to transport and less susceptible to damage during transport. In addition, the folding sheet music stand 100 provides a sturdy platform for holding sheet music for musicians. The sheet music rests on the back sheet music holder 102 and the bottom sheet music holder 104. The main shaft can be adjusted upwardly or downwardly with respect to the folding legs 110 by use of clap 112. In addition, a secondary shaft 108 slides within the opening of the main shaft 106 and can be adjusted using clap 114. Collar 111 surrounds the main shaft 106 and is attached to clamp 112. The main shaft is capable of sliding in the collar 111 and being fixed in position with respect to collar 111 by tightening of clamp 112. Folding legs 110 are attached to the collar 111 via pivoting leg hinges 152.

Figure 2:
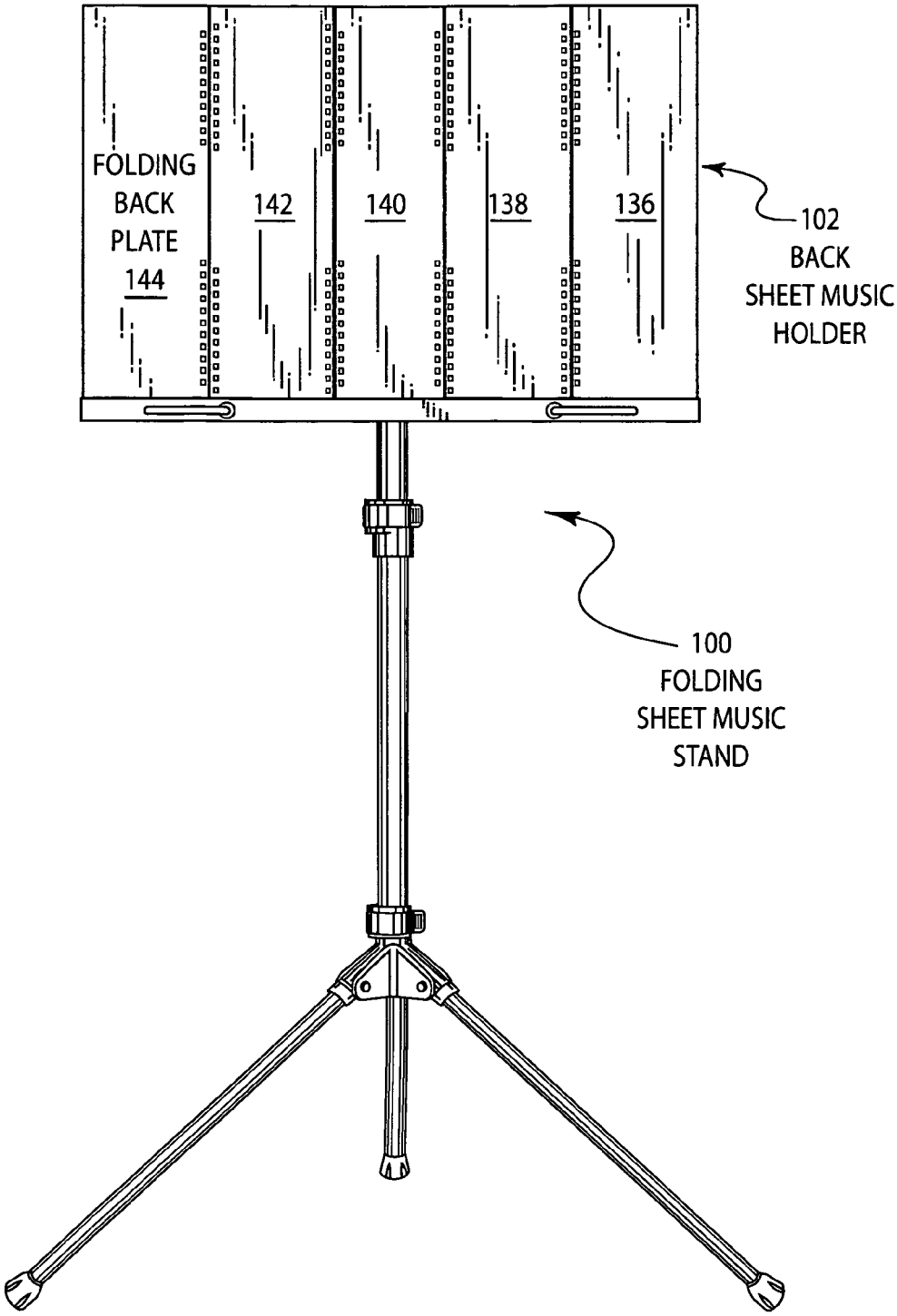
FIG. 2 is a front view of the folding sheet music stand of FIG. 1.

FIG. 2 is a front view of the folding sheet music stand 100. As can be seen from FIG. 2, the back sheet music holder 102 comprises a series of folding back plates 136, 138, 140, 142 and 144.

Figure 3:
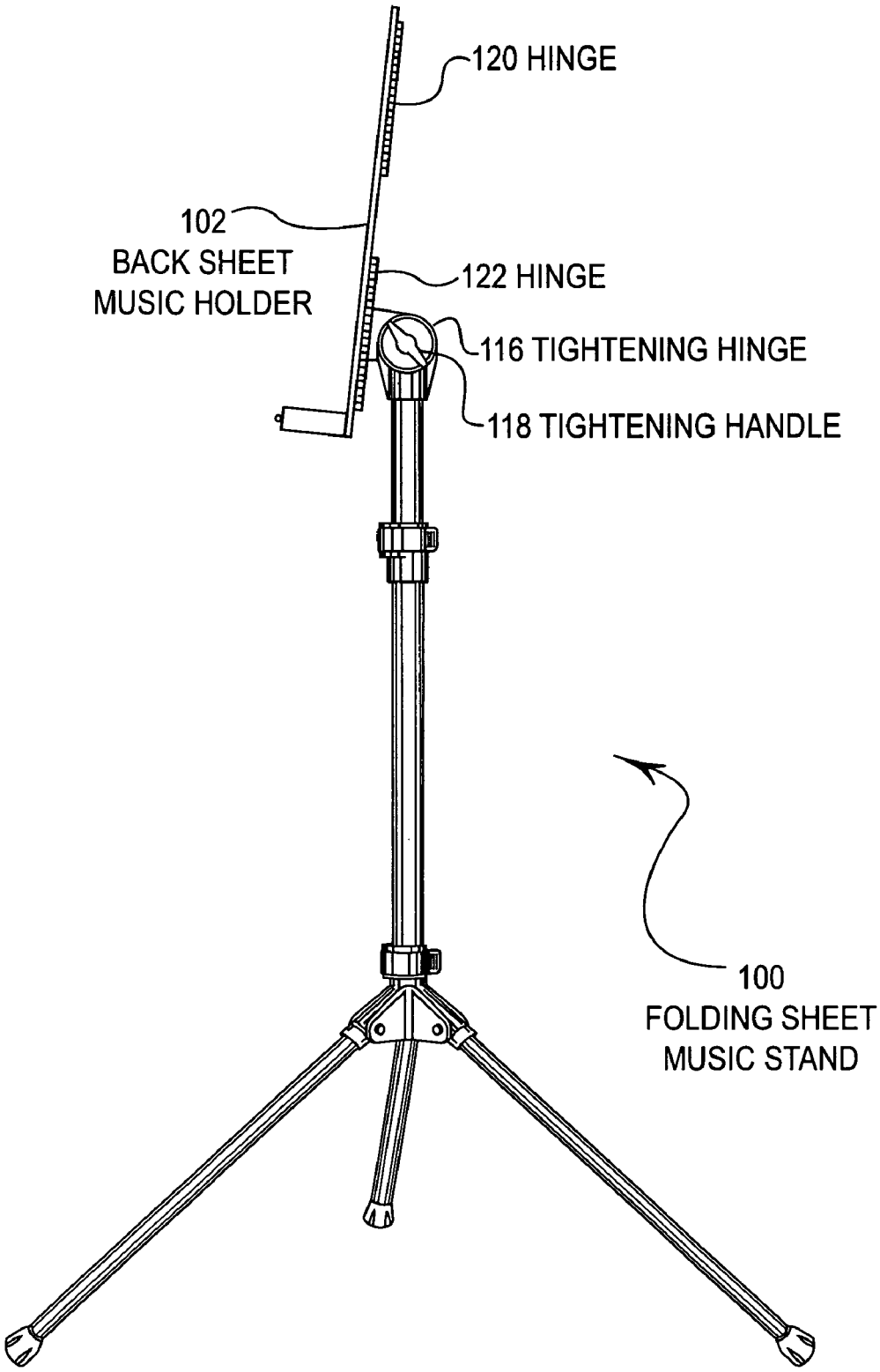
FIG. 3 is a right side view of the folding sheet music stand of FIG. 1.

FIG. 3 is a right side view of the folding sheet music stand 100. As can be seen from FIG. 3, the back sheet music holder 102 is connected to a tightening hinge 116 that allows the back sheet music holder 102 to rotate to different angles with respect to the remaining portion of the sheet music stand 100. A tightening handle 118 is used to tighten the tightening hinge 116 in a desired orientation. For example, the back sheet music holder 102 can be rotated to a position for placement of sheet music on the back sheet music holder 102. Alternatively, the back sheet music holder 102 can be rotated in a clockwise direction until it is in a nearly vertical orientation, which is the orientation in which the folding sheet music stand 100 can be folded into a compact and completely folded position. By rotating the tightening handle 118, the back sheet music holder 102 can be fixed with regard to the rest of the folding sheet music stand 100. As also shown in FIG. 3, hinge 120 and hinge 122 are on the back portion of the back sheet music holder 102 and function to allow the folding back plates to fold with respect to one another. Hinge 120 and hinge 122 allow the back folding plates 136, 138 to fold with respect to one another until the back plates 136, 138 abut and form a substantially flat surface that forms the back sheet music holder 102.

Figure 4:
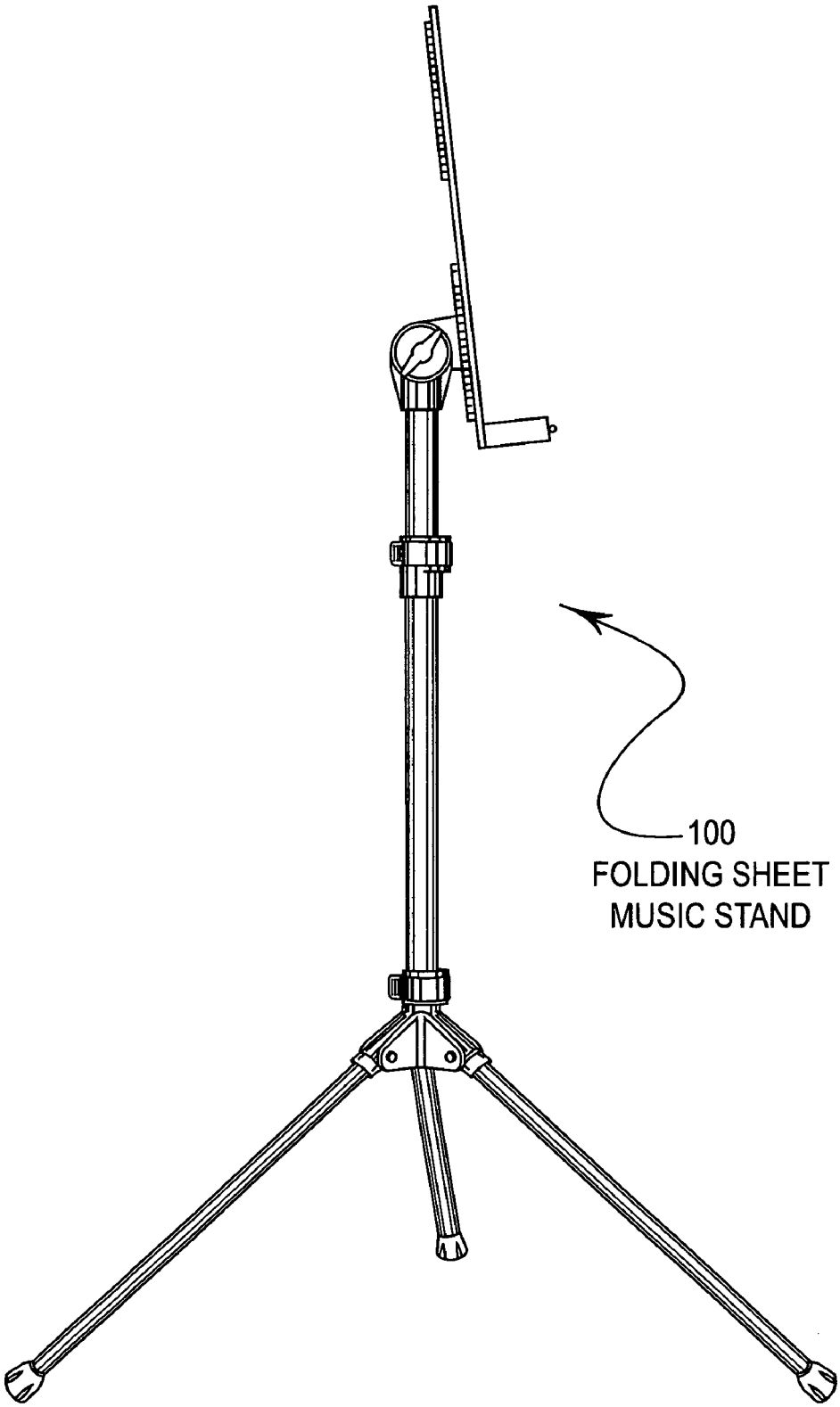
FIG. 4 is a left side view of the folding sheet music stand of FIG. 1.

FIG. 4 is a left side view of the folding sheet music stand 100. FIG. 4 is similar to FIG. 3 and shows similar parts on the left side of folding sheet music stand 100.

Figure 5:
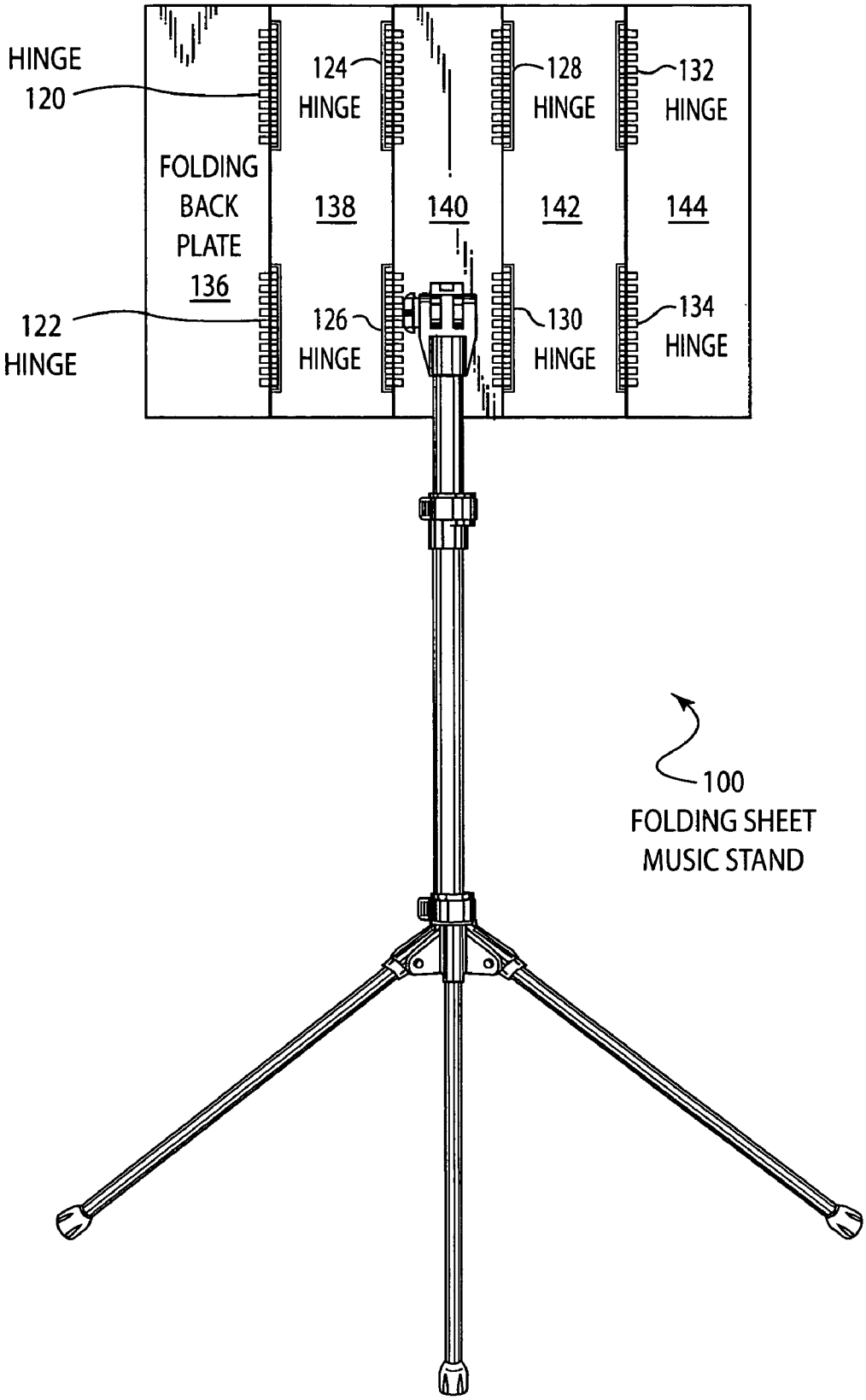
FIG. 5 is a rear view of the folding sheet music stand of FIG. 1.

FIG. 5 is a back view of the folding sheet music stand 100. As shown in FIG. 5, folding back plate 136 is connected to folding back plate 138 by hinge 120 and hinge 122. Similarly, folding back plate 138 is connected to folding back plate 140 by hinge 124 and hinge 126. Folding back plate 140 is connected to folding back plate 140 by hinge 128 and hinge 130. Folding back plate 142 is connected to folding back plate 144 by hinge 132 and hinge 134. When viewed from the top, the hinges allow folding back plate 136 and folding back plate 138 to rotate in a counterclockwise position. Also viewed from the top, folding back plate 142 and folding back plate 144 rotate in clockwise direction. As indicated above, each of the folding back plates 136-144 abut with each other on the front surface, and the hinges are placed so that a substantially flat surface is formed on the front of the back sheet music holder 102.

Figure 6:
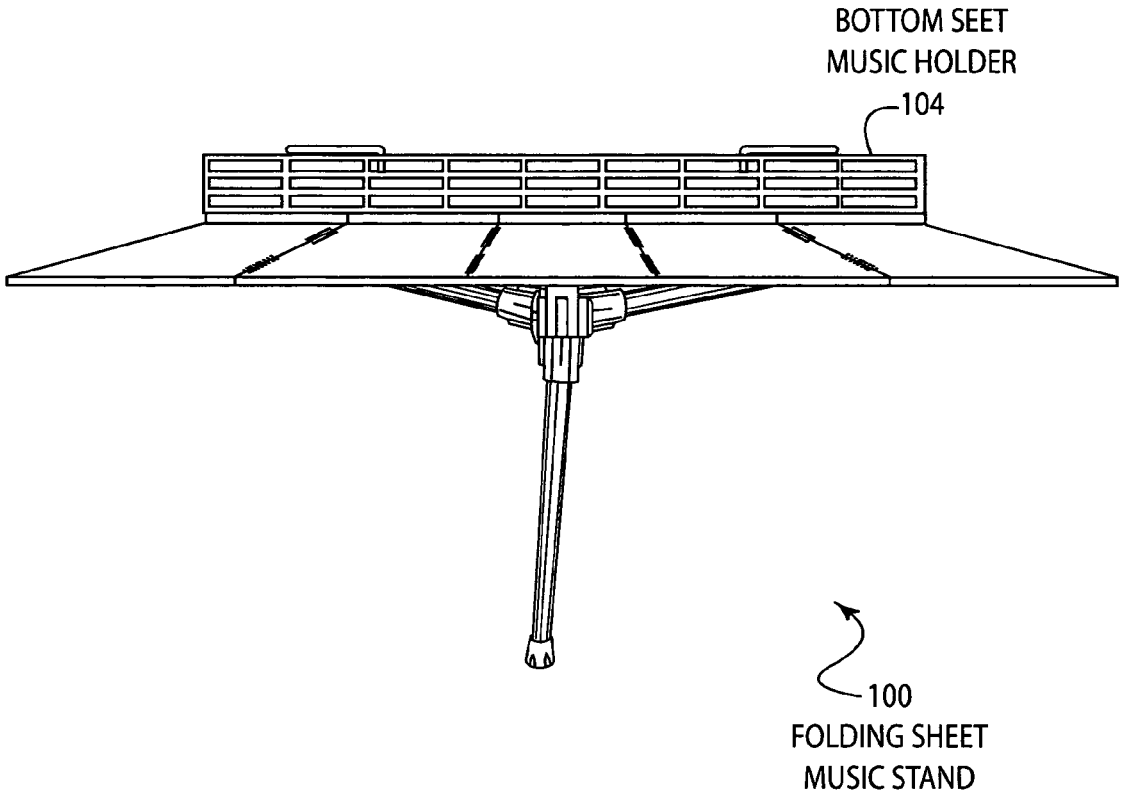
FIG. 6 is a top view of the folding sheet music stand of FIG. 1.

FIG. 6 is a top view of the folding sheet music stand 100. The bottom sheet music holder 104 may contain ribs, as shown in FIG. 6, to reduce the overall weight of the folding sheet music stand 100.

Figure 7:
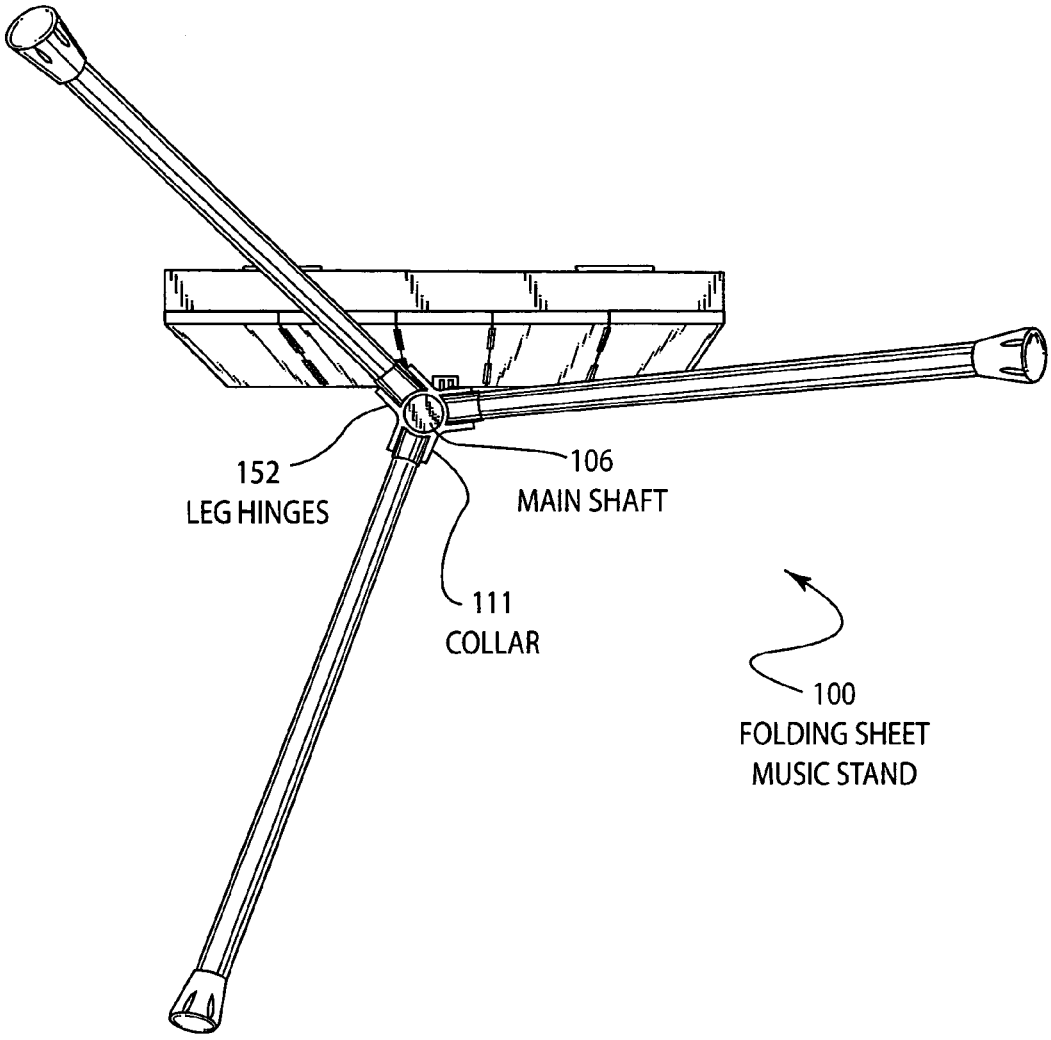
FIG. 7 is a bottom view of the folding sheet music stand of FIG. 1.

FIG. 7 is a bottom view of the folding sheet music stand 100. As can be seen from FIG. 7, the folding legs 110 are attached by the leg hinges 152 to a collar 111 that surrounds the main shaft 106.

Figure 8:
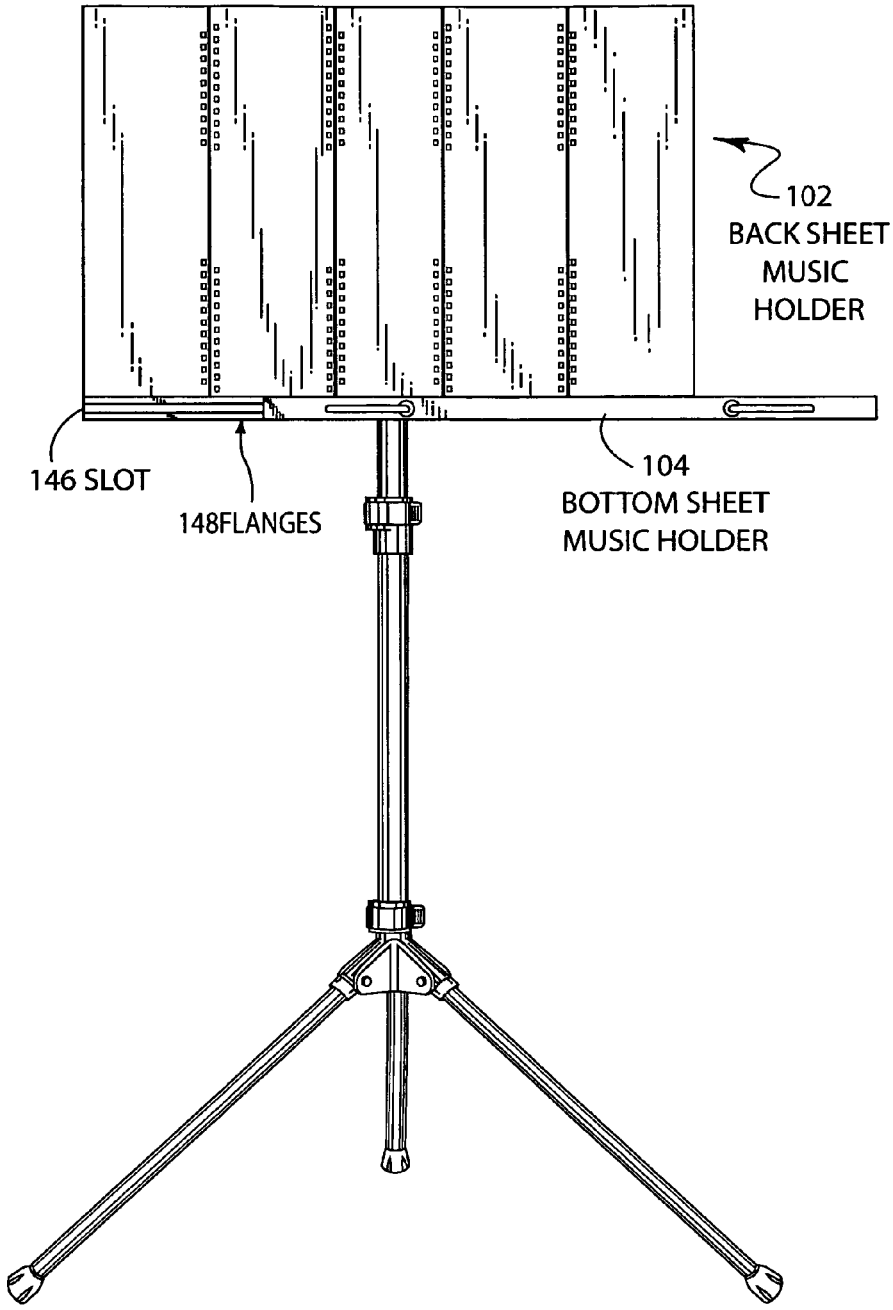
FIG. 8 is a front view of the folding sheet music stand with the bottom sheet music holder partially removed.

FIGS. 8 through 21 disclose the manner in which the folding sheet music stand 100 can be disassembled and folded into a compact bundle for transport. FIG. 8 is a front view of the folding sheet music stand 100 with the bottom sheet music holder 104 partially removed from the back sheet music holder 102. As shown in FIG. 8, the bottom sheet music holder 104 slides in a slot 146 that is formed by flanges 148.

Figure 9:
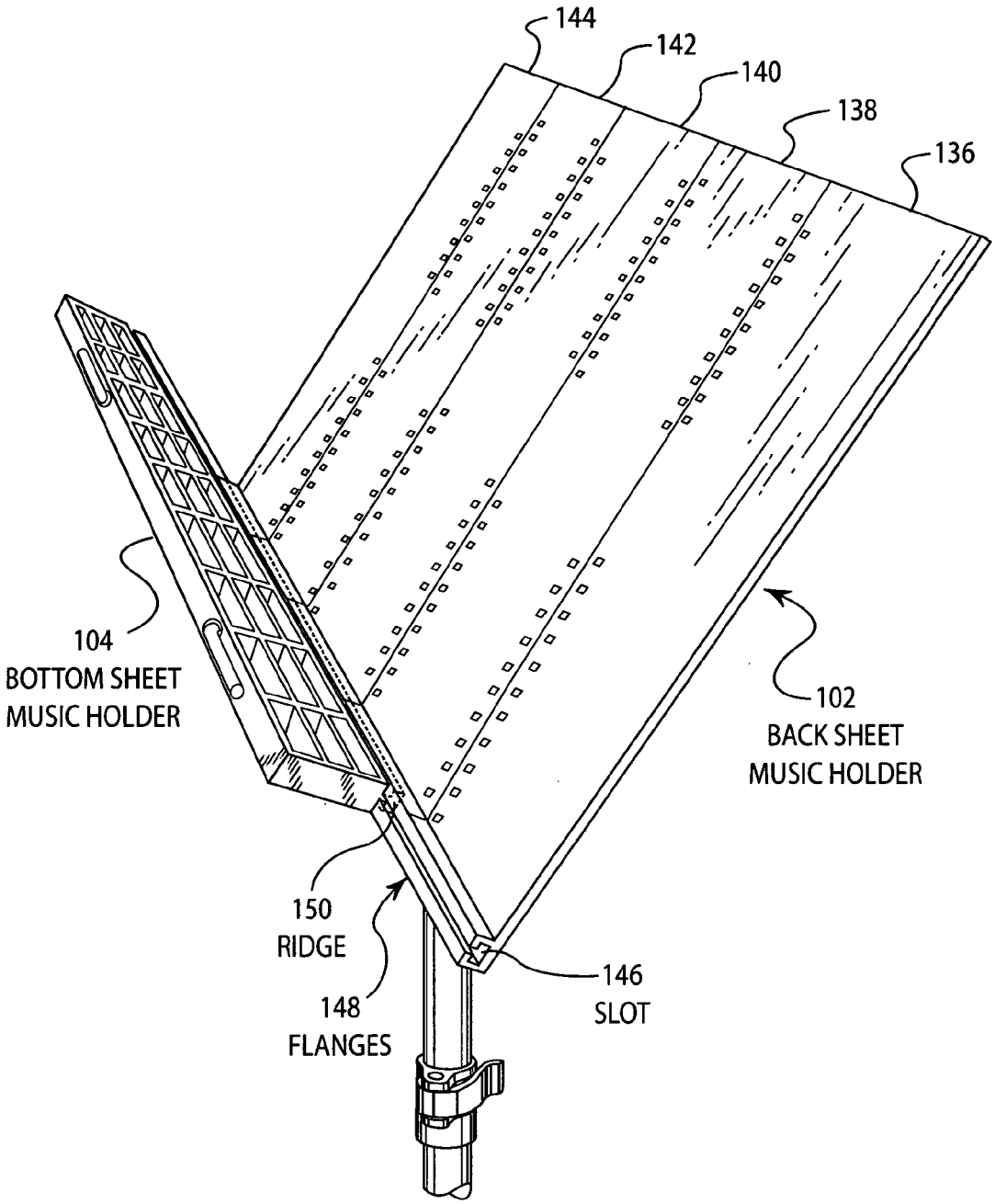
FIG. 9 is an isometric view of the top portion of the folding sheet music stand with the bottom sheet music holder partially removed.

FIG. 9 is an isometric view illustrating the manner in which the bottom sheet music holder 104 can be disengaged from the back sheet music holder 102. As shown in FIG. 9, a slot 146 is formed between the flanges 148. A ridge 150 is formed along one edge of the bottom sheet music holder 104 that engages the slot 146. In this fashion, the bottom sheet music holder 104 can be slid into the slot 146 and hold each of the folding back plates 136-144 in a stationary position.

Figure 10:
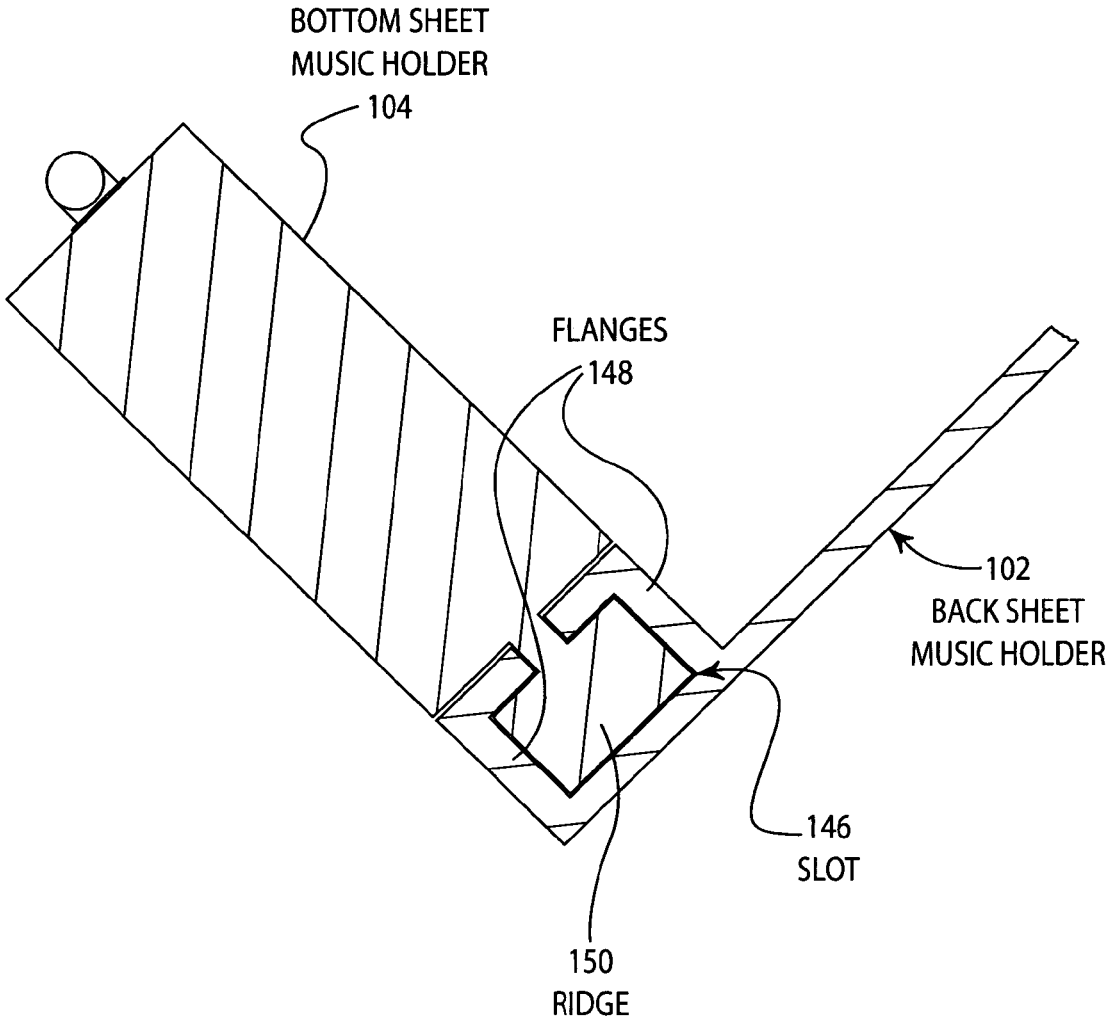
FIG. 10 is a schematic cut-away view illustrating the manner in which the bottom sheet music holder engages the back sheet music holder.

FIG. 10 is a schematic cut-away view illustrating the manner in which the bottom sheet music holder 104 engages the back sheet music holder 102. As shown in FIG. 10, the bottom sheet music holder 104 has a ridge portion 150 that extends along the edge of the bottom sheet music holder 104. The ridge 150 slides into the slot 146 that is formed by the flanges 148. The engagement of the ridge 150 and the flanges 148 holds each of the folding back plates in a structurally solid position so that they are aligned in a flat orientation along the surface the back sheet music holder 102. Each of the parts can be constructed from any desired type of material such as hard plastic, aluminum, steel or other metals. The tolerances provided between the ridge portion 150 and the slot 146 allow the bottom sheet music holder 104 to be inserted and removed by hand while providing a secure structural support with a minimal amount of play between each of the folding back plates that form a sturdy back sheet music holder 102.

Figure 11:
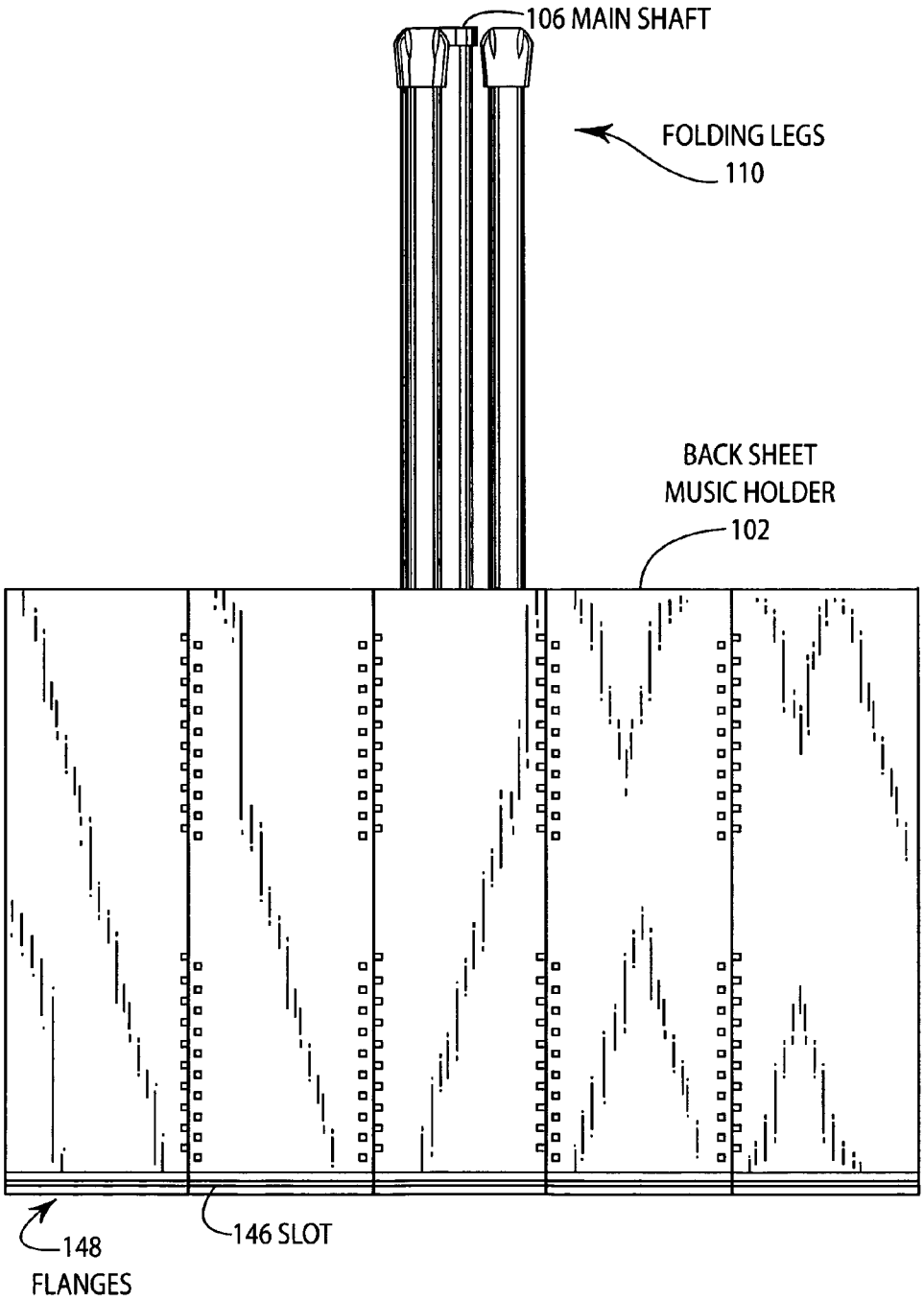
FIG. 11 is a front view of the folding sheet music holder with the legs retracted and pivoted upwardly.

FIG. 11 is a front view of the folding sheet music stand 100. The bottom sheet music holder 104 (not shown) is removed from the slot 146 and flanges 148 of the back sheet music holder 102. In addition, the folding legs 110 have been folded to a vertical position and rotated upwardly using the tightening hinge 116 (not shown) and tightening handle 118 (not shown). Further, the main shaft 106 has been lowered using clamp 112 (not shown) and clamped into a position that is substantially even with the bottom of the folding legs 110. By adjusting the main shaft 106 to the same length as the folding legs 110, a compact bundle can be formed comprising the folding legs 110 and main shaft 106.

Figure 12:
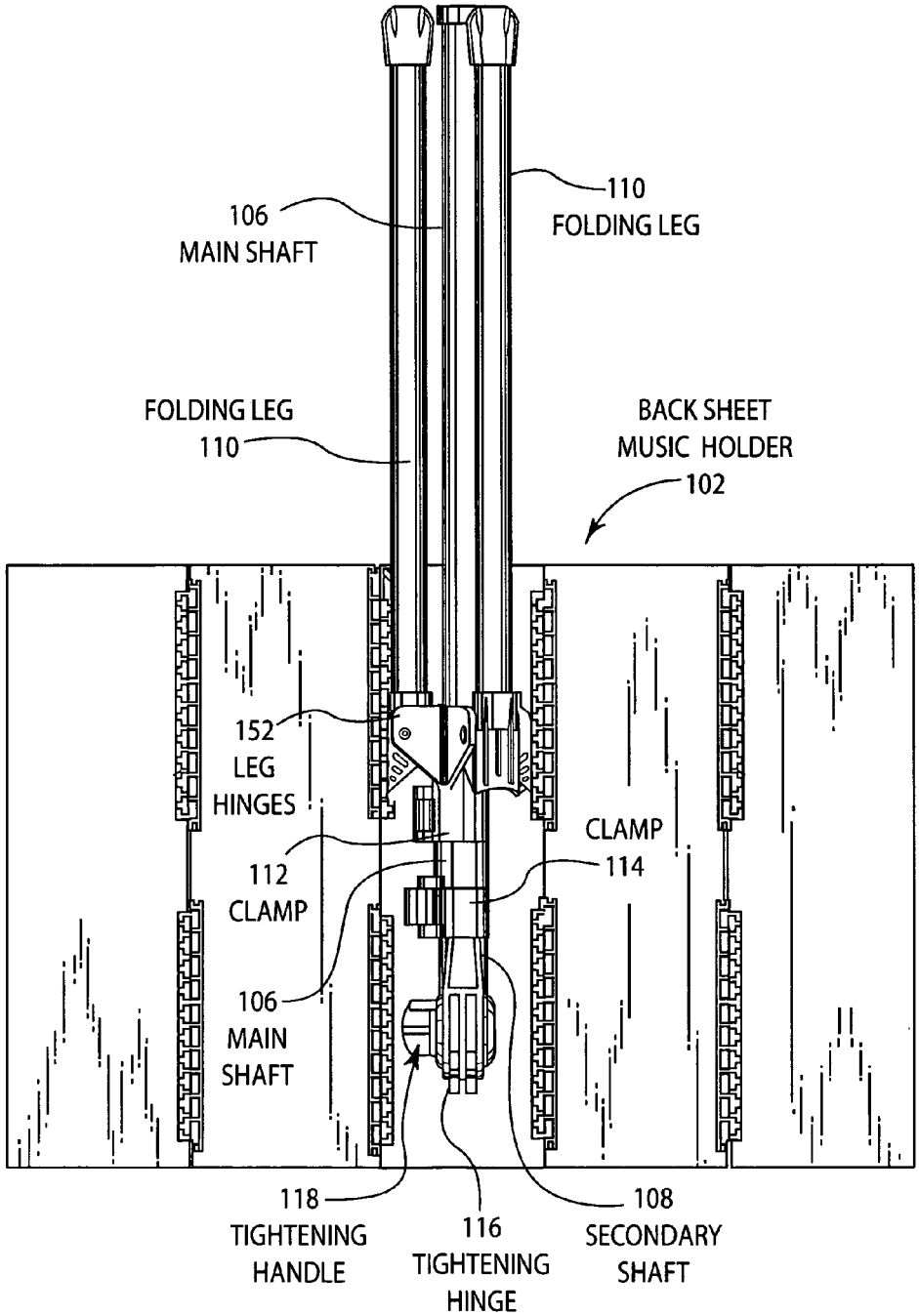
FIG. 12 is a back view of one embodiment of the folding sheet music stand with the legs retracted and rotated in an upward position.

FIG. 12 is a back view of the folding sheet music stand 100 that corresponds to FIG. 11 showing the folding legs 110 rotated into an upward position and folded together. Leg hinges 152 allow the legs to fold together. As also shown in FIG. 12, the main shaft 106 is moved into a closed position so that the end of the main shaft 106 is even with the end of the folding legs 110. Clamp 112 clamps the main shaft 106 into the position shown so that the main shaft 102 is fixed. Clamp 114 clamps the secondary shaft 108 into a closed position which is recessed within the main shaft 106. Clamp 114 holds the secondary shaft 108 in a fixed, closed condition on main shaft 106. Tightening hinge 118 is used to rotate the entire assembly including the secondary shaft 108, clamp 114, main shaft 106, clamp 112, hinges 152, and folding legs 110 into a vertical position. The tightening handle 118 is then used to secure that assembly with respect to the back sheet music holder 102.

Figure 13:
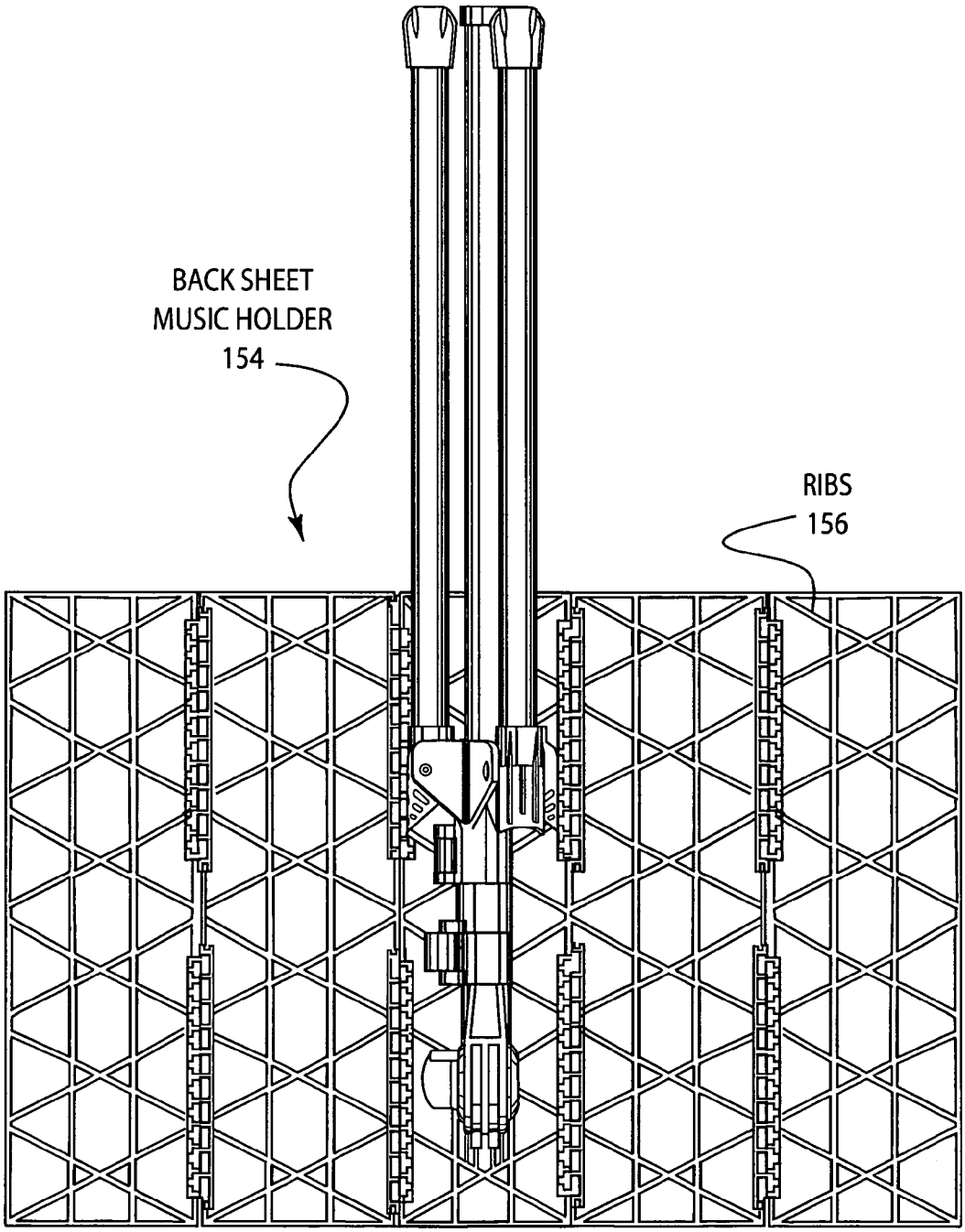
FIG. 13 is a back view of another embodiment of the folding sheet music stand with the legs retracted and rotated in an upward position.

FIG. 13 illustrates an alternative embodiment of the back sheet music holder 154 that has ribs 156 for supporting and providing structural rigidity to the back sheet music holder 154. Again, the back sheet music holder, as well as all of the other parts of the various embodiments illustrated herein, can be made from a rigid plastic, metal, a combination of plastic and metal, or any other suitable material.

Figure 14:
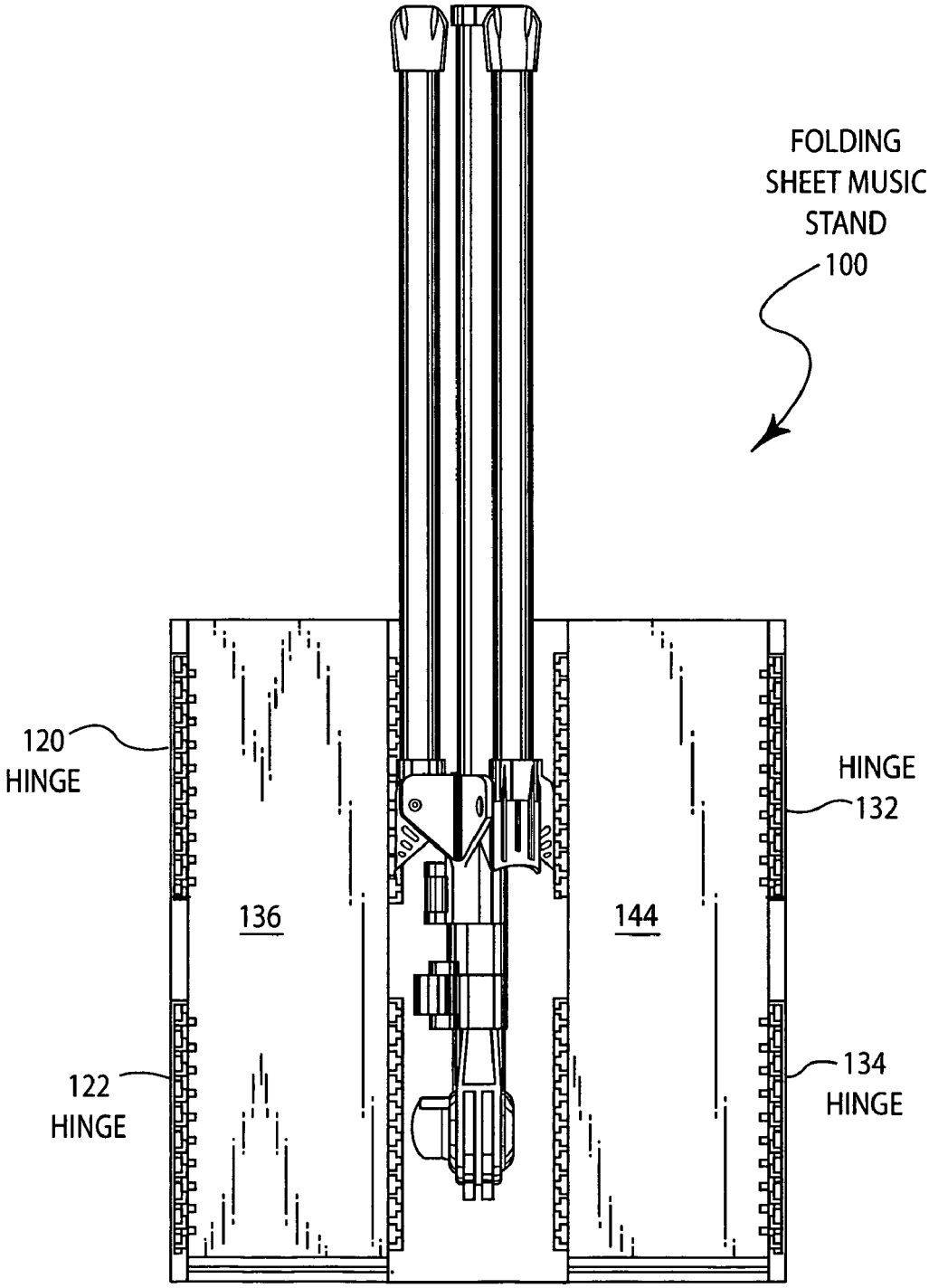
FIG. 14 is a back view of the folding sheet music stand with the legs in a retracted position and rotated upwardly and the back sheet music holder partially folded.

FIG. 14 is a back view of the folding sheet music stand 100 illustrating folding back plate 136 and folding back plate 144 in a folded position. Hinge 120 and hinge 122 allow the folding back plate 136 to rotate into a folded position as shown in FIG. 14. Similarly, hinge 132 and hinge 134 allow folding back plate 144 to rotate into the folded position illustrated in FIG. 14.

Figure 15:
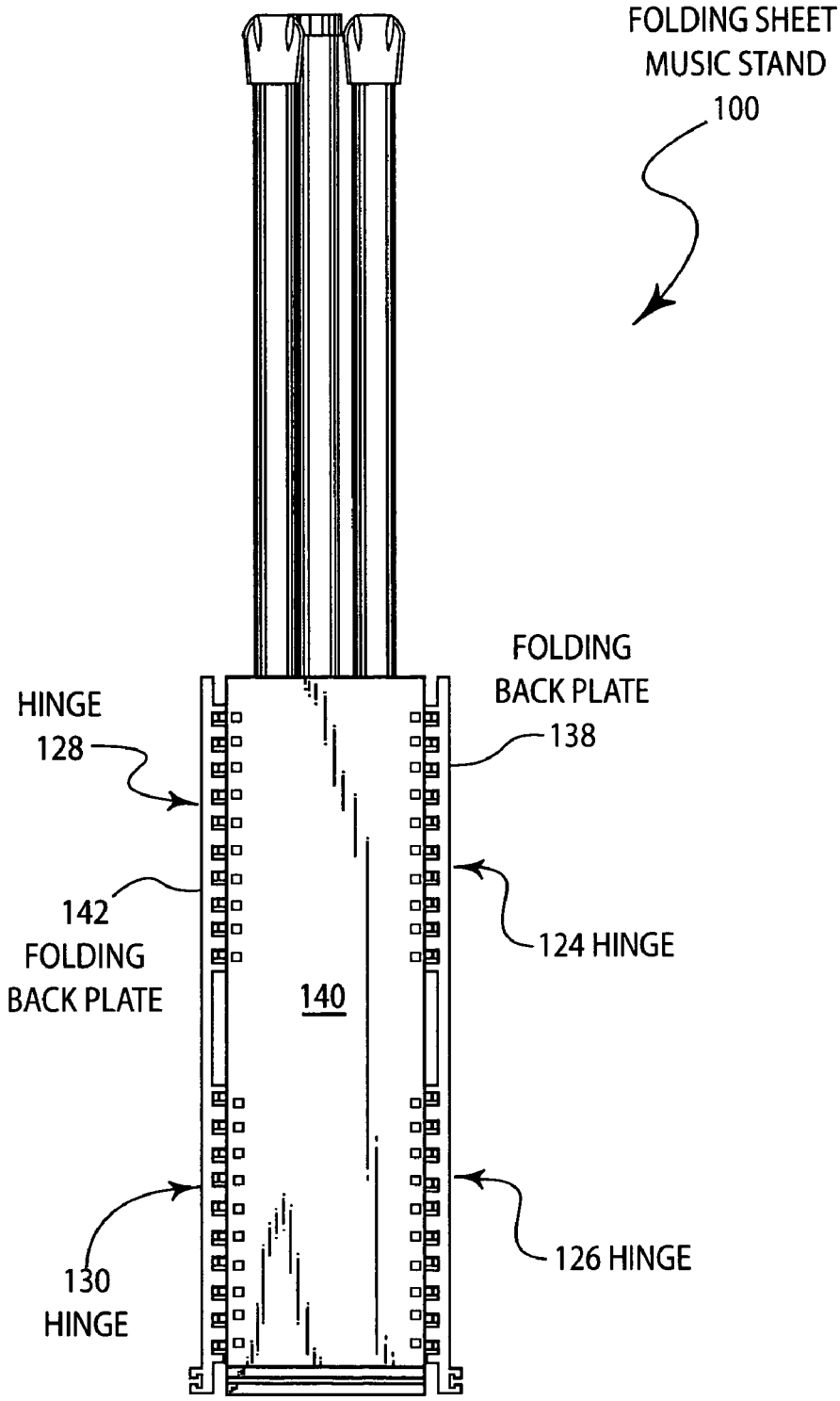
FIG. 15 is a front view of the folding sheet music stand with the legs in a retracted position and rotated upwardly and the back sheet music holder fully folded.

FIG. 15 is a front view of the folding sheet music stand 100 in a completely folded position. As shown in FIG. 15, hinge 128 and hinge 130 allow the folding back plate 142 to rotate into a folded position with respect to folding back plate 140. Similarly, hinge 124 and hinge 126 allow the folding back plate 138 to rotate into a folded position with respect to folding back plate 140.

Figure 16:
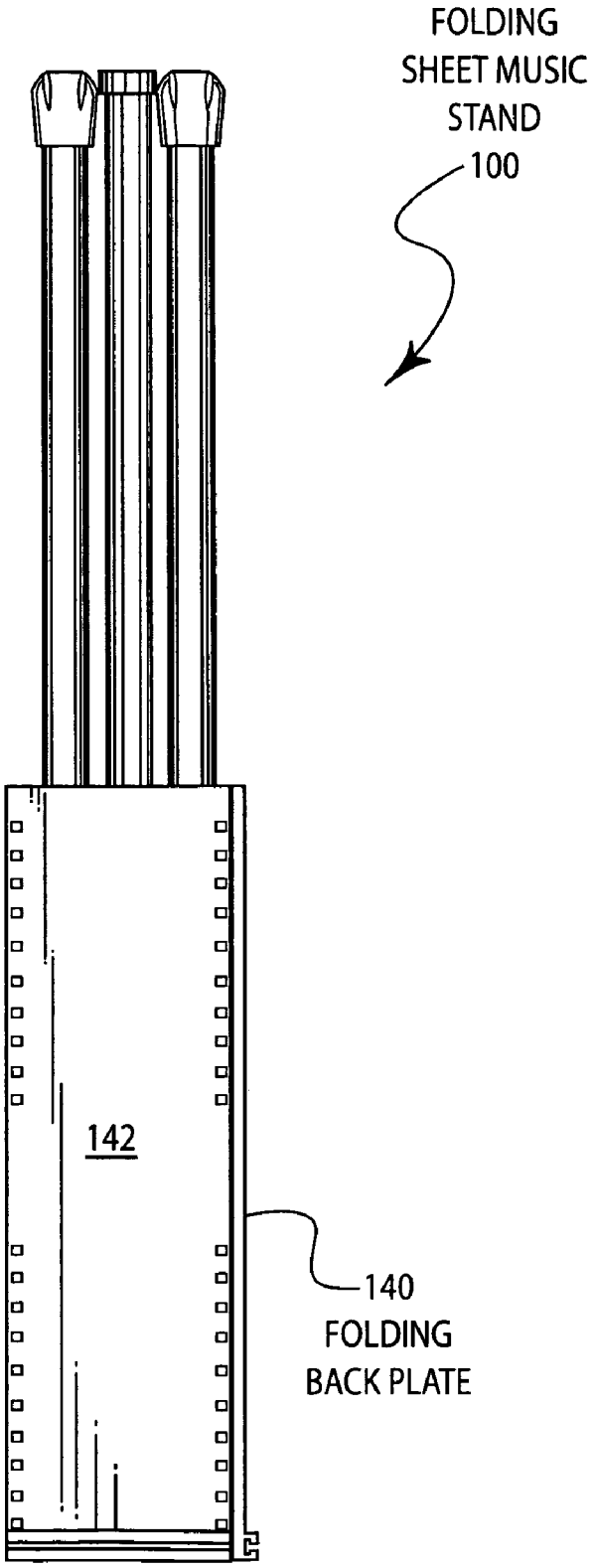
FIG. 16 is a right side view of FIG. 15.

FIG. 16 is a right side view of the folding sheet music stand 100. As shown in FIG. 16, the folding back plate 142 is folded to an angle that is substantially normal to the folding back plate 140.

Figure 17:
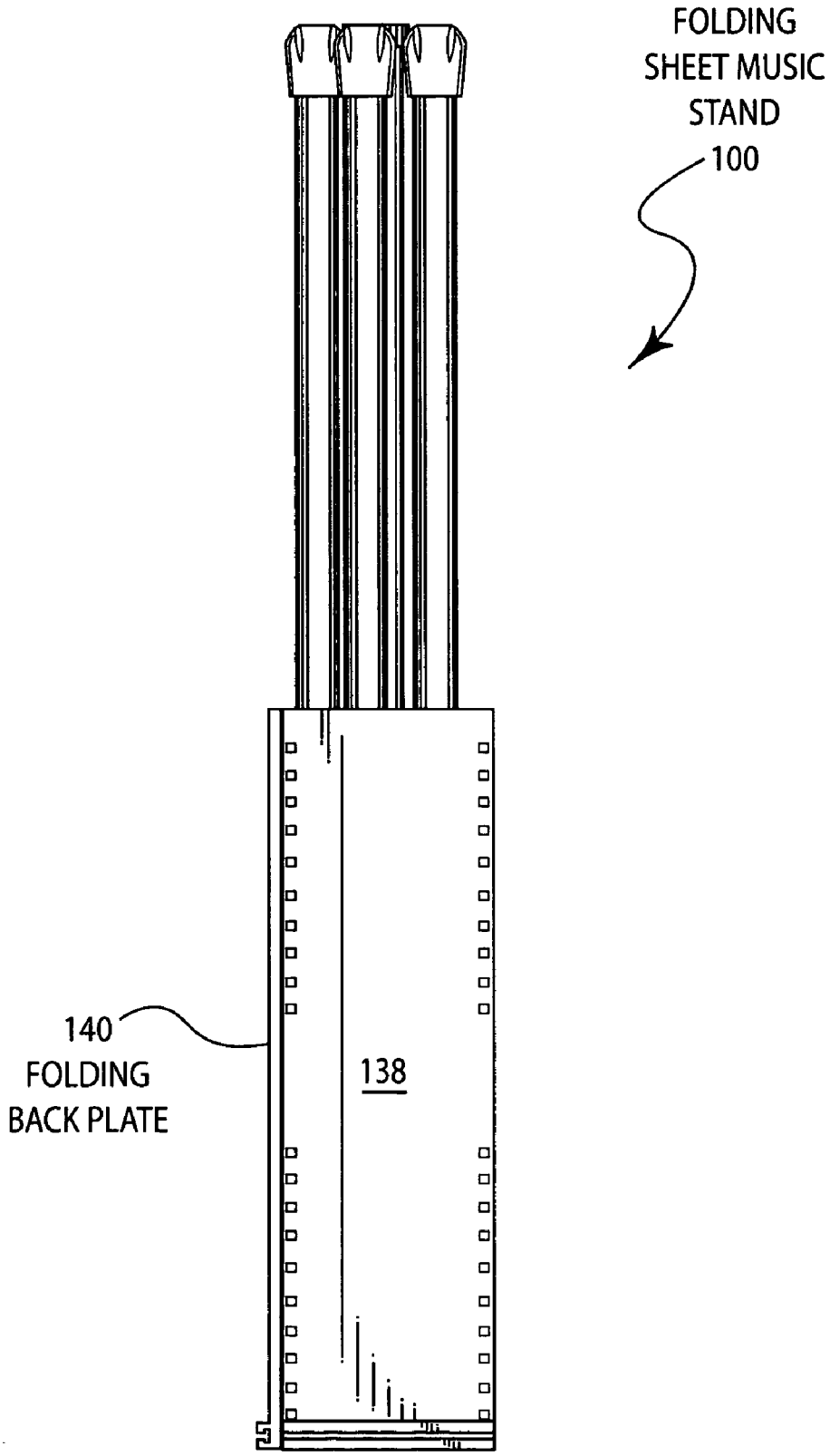
FIG. 17 is a left side view of FIG. 15.

FIG. 17 is a left side view of the folding sheet music stand 100. As shown in FIG. 17, the folding back plate 138 is folded into a position that is substantially normal to the folding back plate 140.

Figure 18:
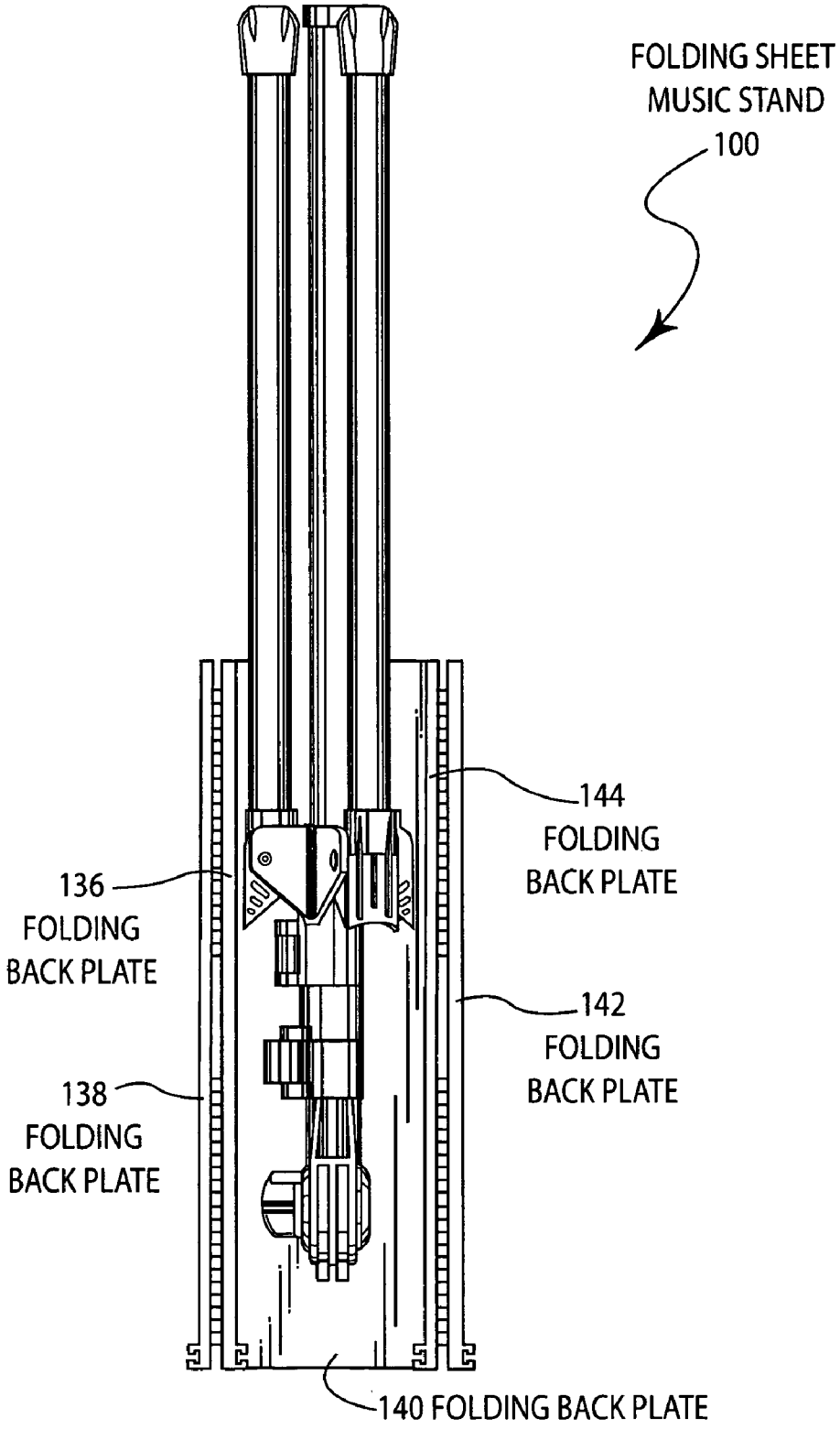
FIG. 18 is a back view of FIG. 15.

FIG. 18 is a back view of the folding sheet music stand 100 in a fully folded position. As shown in FIG. 18, folding back plate 142 and folding back plate 144 are folded together and rotated to a position that is substantially normal to the folding back plate 140. Similarly, folding back plate 136 and folding back plate 138 are folded together and rotated to a position that is substantially normal to the folding back plate 140. As a result, the folding sheet music stand 100 is in a fully folded position which is compact and easily transportable.

Figure 19:
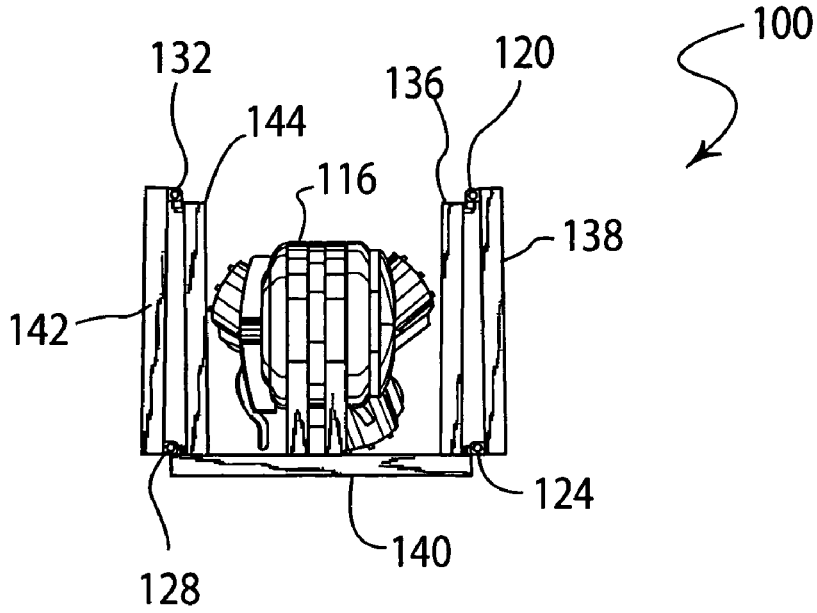
FIG. 19 is a top view of the folding sheet music stand in a fully folded and compact position.

FIG. 19 is a top view of the folding sheet music stand 100. As shown in FIG. 19, the tightening hinge 116 is attached to the center folding back plate 140. Folding back plate 136 and folding back plate 138 are folded together by hinge 120 and hinge 122 (not shown) and rotated to a position that is substantially normal to the center folding back plate 140 using hinge 124 (not shown) and hinge 126 (not shown). Similarly, folding back plate 142 and folding back plate 144 are folded together using hinge 132 and hinge 134 (not shown). That assembly is rotated to a position where it is substantially normal to the center folding back plate 140 using hinge 128 and hinge 130 (not shown).

Figure 20:
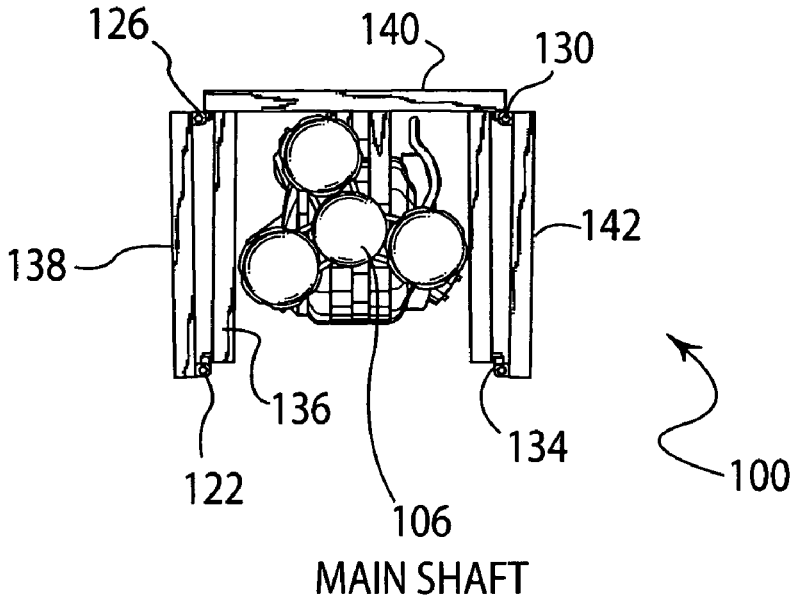
FIG. 20 is a bottom view of FIG. 19.

FIG. 20 is a bottom view of the folding sheet music stand 100 in the fully folded position. As shown in FIG. 20, the main shaft 106 has the three folding legs 110 pivoted into a compact position around the main shaft 106. The folding back plate 136 and folding back plate 138 are rotated into a folded position using hinge 120 (not shown) and hinge 122. That assembly is rotated to a position that is substantially normal to the center folding back plate 140 using hinge 124 (not shown) and hinge 126. Similarly, folding back plate 142 and folding back plate 144 are rotated to a folded position using hinge 132 (not shown) and hinge 134. That assembly is rotated to a position where it is substantially normal to the center folding back plate 140 using hinge 128 (not shown) and hinge 130.

Figure 21:
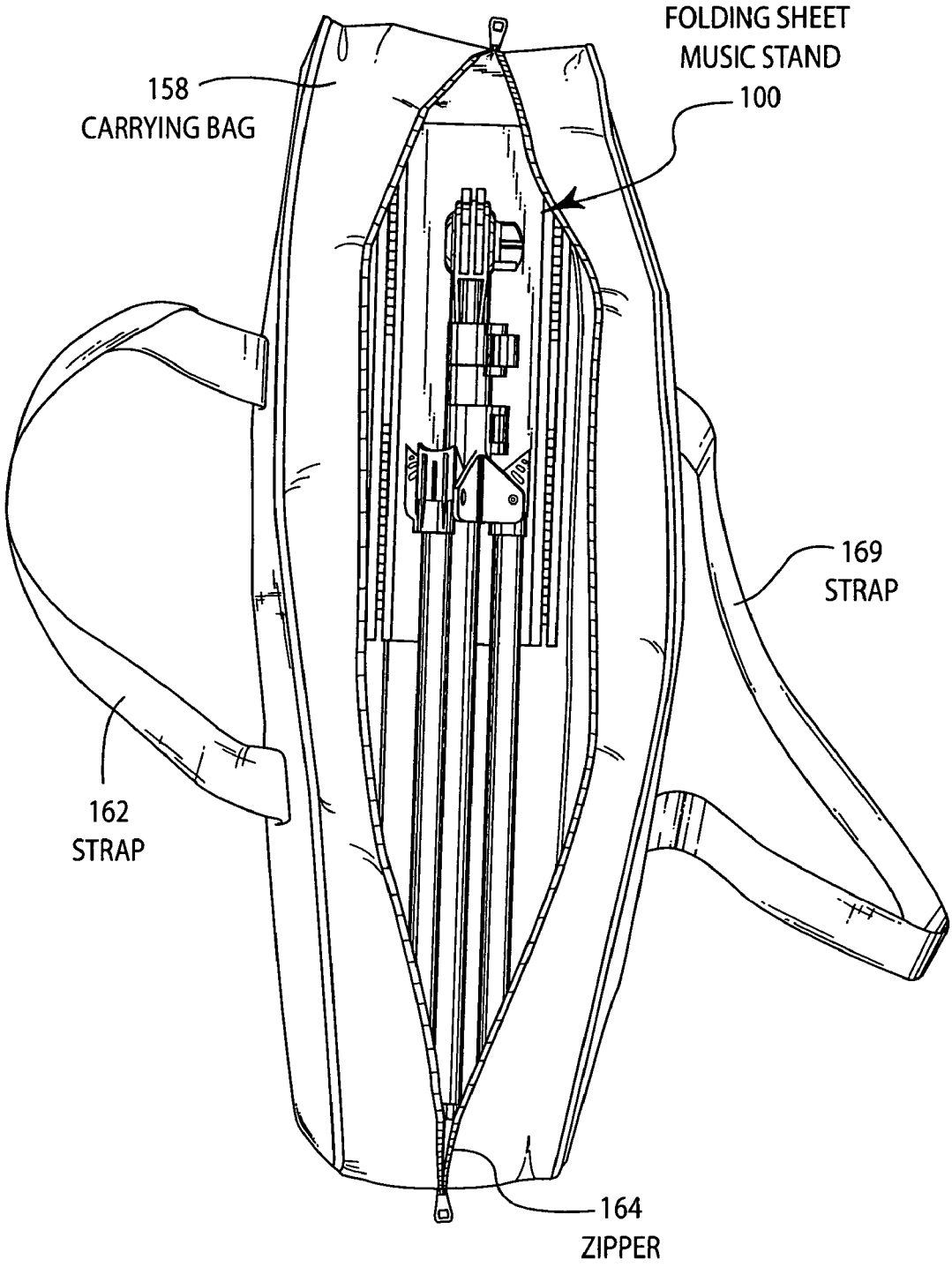
FIG. 21 is an isometric view illustrating the manner in which the sheet music stand, in a fully folded and compact position, can be loaded into a carrying case.

FIG. 21 is a top view of the folding sheet music stand 100 disposed in a carrying bag 158. FIG. 21 illustrates the manner in which the folding sheet music stand 100 can be easily transported in a carrying bag 158. The carrying bag has a zipper 164 and straps 160, 162 for allowing easily transport of the carrying bag 158.

The present invention therefore provides a unique folding sheet music stand 100 that can be folded into a compact position for user easy transportation which prevents potential damage to the folding sheet music stand. The carrying bag 158 can be used to transport the fully folded sheet music stand 100 in a compact position that is less susceptible to damage.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A folding sheet music stand that provides a sturdy platform for holding sheet music, is adjustable for different heights and orientations and is capable of being folded into a compact package that can be easily carried without damage to said folding sheet music stand comprising:

a main shaft;

a collar assembly surrounding said main shaft;

a first clamp attached to said collar that fixes said main shaft with respect to said collar assembly and allows adjustment of the position of said main shaft with respect to said collar assembly;

folding legs that support said folding sheet music stand;

leg hinges attached to said collar assembly and said folding legs that allow said folding legs to fold to a compact position and to open to an open position to support said folding sheet music stand;

a secondary shaft disposed inside of said main shaft, said secondary shaft having a size that allows said secondary shaft to fit firmly in said main shaft and to slide in said main shaft;

a second clamp attached to said main shaft that fixes said main shaft with respect to said secondary shaft and forms an extendable leg assembly that includes said main shaft, said collar, and first clamp, said folding legs, said leg hinges, said secondary shaft and said second clamp;

a back sheet music holder having a center folding back plate and side back plates that are attached by hinges to said center folding back plate that allow said side back plates to unfold to an open position to form a flat front surface for placement of said sheet music, and to fold away from said flat front surface to a folded position so that said side back plates are disposed at an angle to said center folding back plate to form an angular opening between said side back plates and said center back plate;

flanges formed on said back sheet music holder that form a slot, said flanges having at least one surface that is substantially parallel to said flat front surface;

a bottom sheet music holder having a ridge formed along one edge, said ridge having a size and shape that allows said ridge to slide firmly within said slot so as to fix said center back plate and said side back plates in a stationary position to form said flat front surface, said ridge having at least one surface that engages said at least one surface of said flanges that is substantially parallel to said flat front surface so that said side back plates are prevented from folding away from said front flat surface whenever said ridge is engaged in said slot;

a shaft tightening hinge attached to said back sheet music holder on a lower portion of said center back plate when said back sheet music holder is extended into a position for use, and to said secondary shaft so that said extendable leg assembly can be rotated in a first direction along a plane and fixed in said position for use so that said back sheet music holder is in a desired orientation, and rotated in a second direction in said plane so that said extendable leg assembly is disposed within said angular opening between said side back plates and said center back plate.

2. The folding sheet music stand of claim 1 further comprising additional back side plates that are attached with hinges to said side back plates so that said additional side back plates are capable of folding together with said side back plates to create a compact package.

3. The folding sheet music stand of claim 2 wherein said second clamp allows said secondary shaft to be disposed and secured substantially inside of said main shaft, and said first clamp allows said main shaft to be extended between and fixed at a length that substantially matches end portions of said folding legs to create a compact package.

4. A method of folding a sheet music stand into a compact package for transport comprising:

providing a main shaft;

providing a collar;

attaching a first clamp to said collar that allows said main shaft to slide in said collar and fix said collar on said main shaft;

attaching leg hinges to said collar;

attaching folding legs to said leg hinges;

disposing a secondary shaft in said main shaft, said secondary shaft having a size that allows said secondary shaft to slide in said main shaft;

attaching a second clamp to said main shaft to fix said secondary shaft with respect to said main shaft to form an extendable leg assembly that includes said main shaft, said collar, said first clamp, said leg hinges, said folding legs, said secondary shaft and said second clamp;

attaching side back plates to a center back plate using hinges so that said side back plates can unfold to an open position to form a flat front surface with said center back plate and fold away from said flat front surface to a folded position so that said side back plates are disposed at an angle to said center back plate to form an angular opening between said side back plates and said center back plate;

providing flanges on said center back plate and said side back plates that form a slot when said folding back plates are unfolded to form said flat front surface, said flanges having at least one surface that is substantially parallel to said flat front surface;

providing a bottom sheet music holder having a ridge, said ridge having a size and shape that allows said ridge to slide firmly within said slot so as to fix said center back plate and said side back plates in a stationary position to form said flat front surface, said ridge having at least one surface that engages said at least one surface of said flanges that is substantially parallel to said flat front surface so that said back side plates are prevented from folding away from said flat front surface whenever said ridge is engaged in said slot;

sliding said ridge into said slot to fix said plurality of folding back plates in a fixed stationary position;

attaching a shaft tightening hinge to said secondary shaft;

attaching said center back plate to said shaft tightening hinge at a lower portion of said center back plate when said folding sheet music stand is in an open position for use, said shaft tightening hinge allowing said extendable leg assembly to be rotated in a first direction along a plane and fixed in said open position for use, and in a second direction in said plane so that said extendable leg assembly is disposed within said angular opening between said side back plates and said center back plate.

* * * * *